US005357844A

United States Patent [19]

Baur

[11] Patent Number: 5,357,844

[45] Date of Patent: Oct. 25, 1994

[54] RUN-UP CONTROL FOR THE PRESSURE CHEEK IN A DRAWING APPARATUS

[75] Inventor: Siegfried Baur, Göppingen, Fed. Rep. of Germany

[73] Assignee: L. Schuler GmbH, Fed. Rep. of Germany

[21] Appl. No.: 41,181

[22] Filed: Apr. 1, 1993

[30] Foreign Application Priority Data

Apr. 7, 1992 [DE] Fed. Rep. of Germany ..... 4211639

[51] Int. Cl.[5] ..... F01B 1/00

[52] U.S. Cl. ..... 91/172; 92/13; 92/13.1; 92/13.8

[58] Field of Search ..... 60/584; 91/44, 172, 91/508; 92/13, 13.1, 13.6, 13.7, 13.8, 62

[56] References Cited

U.S. PATENT DOCUMENTS

| | | | |
|---|---|---|---|
| 3,771,930 | 11/1973 | Ginzel et al. | 92/13.1 |
| 3,958,493 | 5/1976 | Fujita et al. | 92/13.6 |
| 3,968,735 | 7/1976 | Boisde et al. | 92/62 |
| 4,651,273 | 3/1987 | Braitinger et al. | 364/188 |
| 5,009,673 | 3/1992 | Baur | 72/352 |

FOREIGN PATENT DOCUMENTS

| | | |
|---|---|---|
| 0401534A1 | 5/1990 | European Pat. Off. . |
| 3602236A1 | 7/1987 | Fed. Rep. of Germany . |
| 3835470A1 | 6/1989 | Fed. Rep. of Germany . |
| 3744177A1 | 7/1989 | Fed. Rep. of Germany . |

*Primary Examiner*—Edward K. Look
*Assistant Examiner*—F. Daniel Lopez
*Attorney, Agent, or Firm*—Evenson, McKeown, Edwards & Lenahan

[57] ABSTRACT

A run-up control for the pressure cheek in a drawing apparatus achieves stoppage times during the run-up phase by having a pressure cylinder with first and second pressure spaces as well as a control piston which is fixed in its position in the control cylinder when the second pressure space is acted upon with pressure. The control piston is fixed in its position by a piston rod, a fixed stop and an adjustable stop. The first pressure space is in a continuous flow connection with a mash pressure space which is reduced when the pressure cheek runs up so that the volume of the second pressure space determines the point in time of the stoppage time in the run-up phase of the pressure cheek.

2 Claims, 3 Drawing Sheets

19
2
3
1

PRESS CONTROL
50
15
41
M
6
4
5
6
18
17
20
16
14
11
10
12
13
9
8
7

RUN-UP CONTROL FOR THE PRESSURE CHEEK IN A DRAWING APPARATUS

BACKGROUND AND SUMMARY OF THE INVENTION

The present invention relates to a run-up control for the pressure cheek of a drawing apparatus in a press.

In transfer presses, multi-stage presses, composite press installations and similar forming presses, for increasing the timing rates, it is required that the formed sheet metal parts be gripped by the transfer device immediately after the opening of the tool and thus before reaching the starting height of the pressure cheek. For this purpose, the upward movement of the pressure cheek must be interrupted.

German Patent Document DE 40 32 338 A1 describes a drawing apparatus of a drawing stage in a press which has a pressure cheek for holding the metal sheet during the drawing. The pressure cheek can be acted upon from below by pressure cylinders. Locking cylinders are provided for an intermediate stop when the workpieces are moved upward. For this purpose, the piston rods are applied to a liftable and lowerable console which all pressure rods have in common. Locking cylinders act upon the console, the pistons of which can be controlled away for a continued upward movement of the pressure cheek.

European Patent Document EP 0 151 198 B1 shows a press control which has a pressure control device. The press control generates signals guided on amplifier units for the basic pressure adjustments as a function of the tool and for the pressure adjustments during the operation of the press.

An object of the present invention is to provide a press in which the tool-specific most favorable removal heights are adjustable during the stoppage of the pressure cheek in the run-up phase and the removal height to be adjusted can be achieved by a control also in the case of varying drawing apparatus pressures.

This and other objects are achieved by the present invention which provides a run-up control for a pressure cheek in a drawing apparatus of a press, comprising a first piston rod with a pressure piston with an effective surface which can be acted upon in a drawing direction, the first piston rod being operatively connected with the pressure cheek. A press control adjusts pressure. A control cylinder having first and second pressure spaces and a second piston rod with a control piston that separates the first and second pressure spaces is provided. The main pressure space is in a constant flow connection with the first pressure space, and the second piston rod extends out of the control cylinder. A pressure generator and a pilot valve controlled by the press control are also provided. The second pressure space is flow connected to the pressure generator via the pilot valve. An actuating drive is coupled to the press control. An adjustable stop is operatively connected to the actuating drive so as to be adjustable in a longitudinal dimension of the second piston rod. A fixed stop is coupled to the second piston rod, the fixed stop abutting against the adjustable stop when the second pressure space is pressurized via the pilot valve.

In the individual case, the pre-acceleration cylinder for the run-up control, which exists in any event, can be used in an advantageous manner, in that the fluid amount displaced from the pre-acceleration cylinder under the pressure of the drawing apparatus after the forming displaces a control piston which can be controlled in its yielding movement.

Another advantage is the adjusting possibility of a volume compensation via the stop adjustment as a function of the different drawing pressure after, for example, each tool change. Furthermore, for a stoppage time of the drawing apparatus, in the lower dead center, a pressure compensation may take place as a function of the pressure in the drawing apparatus.

Other objects, advantages and novel features of the present invention will become apparent from the following detailed description of the invention when considered in conjunction with the accompanying drawings.

DETAILED DESCRIPTION OF THE DRAWINGS

Figure 1:
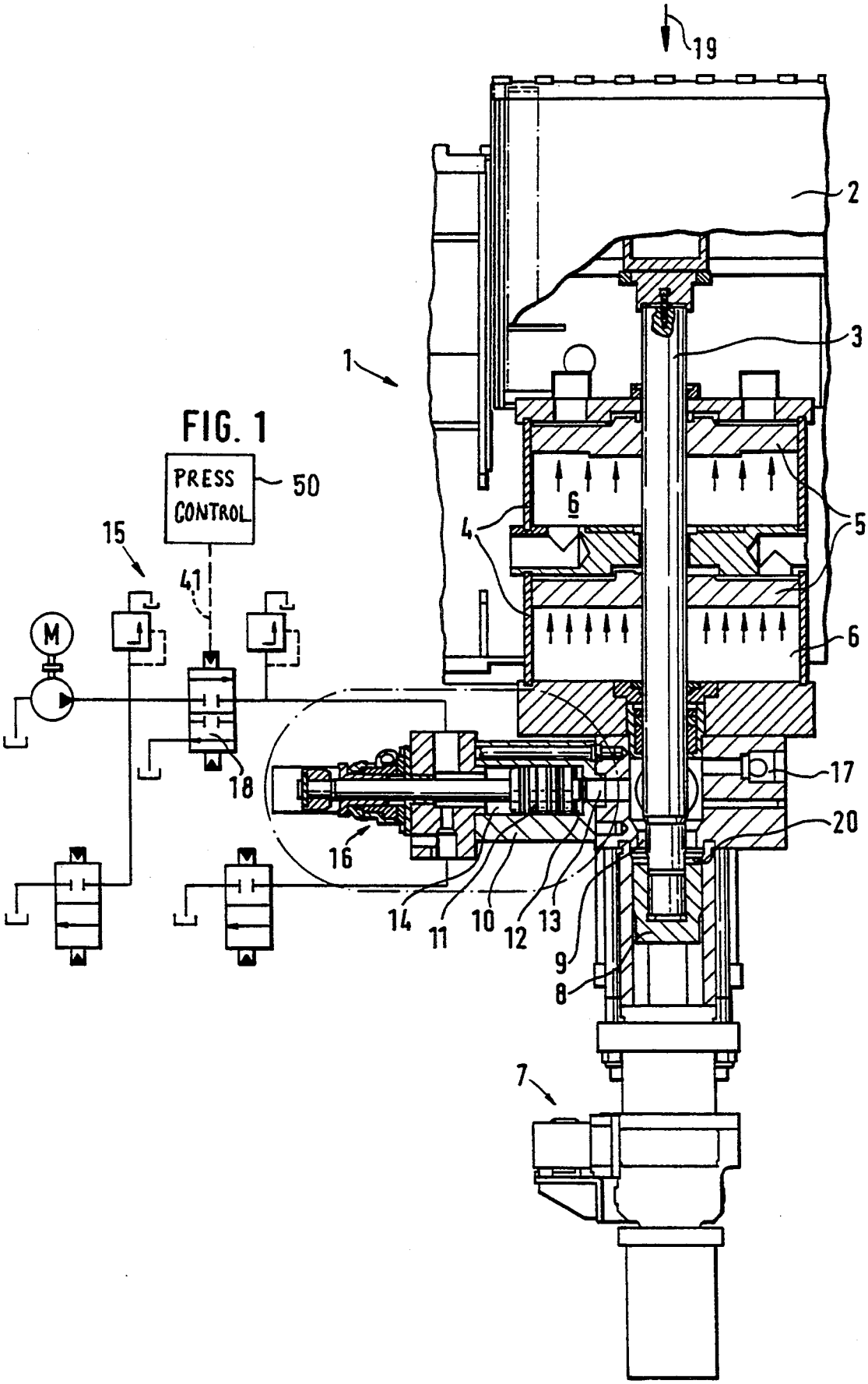
FIG. 1 is a view of a drawing apparatus comprising a pressure cheek with a run-up control according to an embodiment of the present invention.

The drawing apparatus 1, preferably a compressed-air drawing device, has a pressure cheek 2 which interacts with tool-side pressure pins and, by means of these pressure pins, interacts with a blank holder in the tool. Pistons 5 in pressure spaces 6 of pressure cylinders 4 are connected with the pressure cheek 2, in this embodiment by a piston rod 3, for applying the forces and movements of the blank holder and the ejector.

Figure 2:
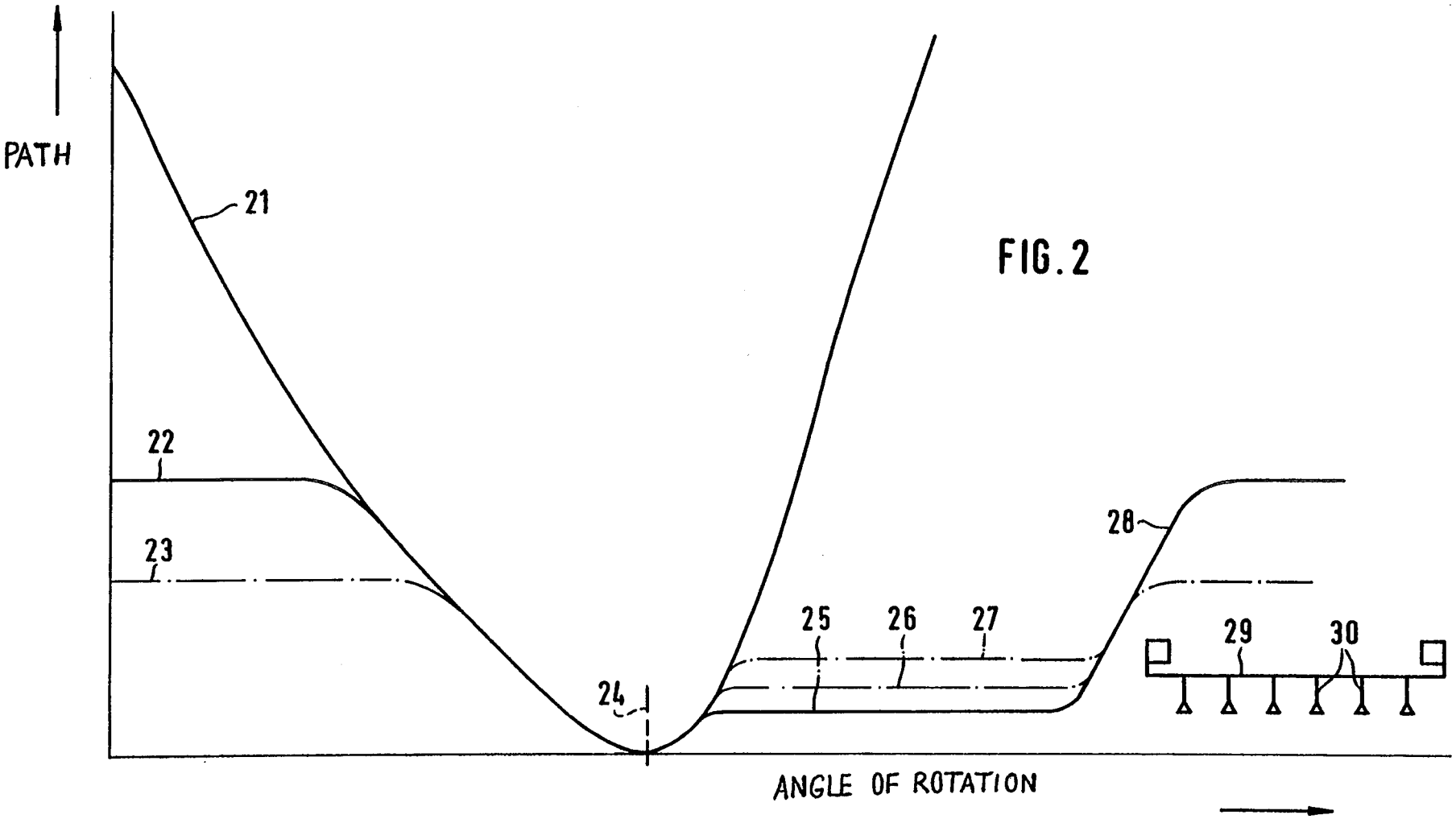
FIG. 2 is a diagram explaining the movements of the drawing apparatus.

The piston rod 3 has an extension that interacts with a run-up stop control 7. This run-up stop control 7 is used for adjusting the initial height for the pressure cheek 2 which in FIG. 2 has the reference number 22 and 23. Furthermore, a pressure piston 8 in a pressure space 9 interacts with the piston rod 3 and forms a pre-acceleration cylinder. The pressure piston 8 has an effective area 20. When the slide moves downward according to curve 21 in FIG. 2, the pressure cheek 2, by the admission of pressure from a pressure source into the pressure space 9 via a valve 17, is lowered in the drawing direction 19 on the sheet metal part resting on the blank holder in the tool bottom part, before the top part of the tool impacts on the slide. This movement is indicated by the curve transition from curve 22 and 23 to curve 21 in FIG. 2. According to the invention, the pressure space 9 with the pressure piston 8 and the effective surface 20 is utilized for controlling the run-up and for the stop (stoppage time of the pressure cheek 2) in the run-up phase for a removal of the sheet metal part. This removal takes place as early as possible by means of suction devices 29, 30 of a transfer system (FIG. 2). However, the presence of such a pre-acceleration cylinder is not a prerequisite of the present invention.

Upon the termination of the forming (drawing) after the lower dead center 24 has been reached, the pressure in the pressure spaces 6 of the pressure cylinders 4 attempts to move the pressure cheek 2 with the piston 5 and the piston rod 3 in the upward direction, illustrated as curve 21 in FIG. 2 after the lower dead center 24 to the transition to the stoppage times 25, 26, 27. The stoppage times are generated by means of the devices 10, 15, 16, 41 described in the following. After the removal of the sheet metal part by means of the suction devices 29, 30, the valve 17 is opened up again in order to let the fluid escape which was not displaced into a first pressure space 12.

Figure 3:
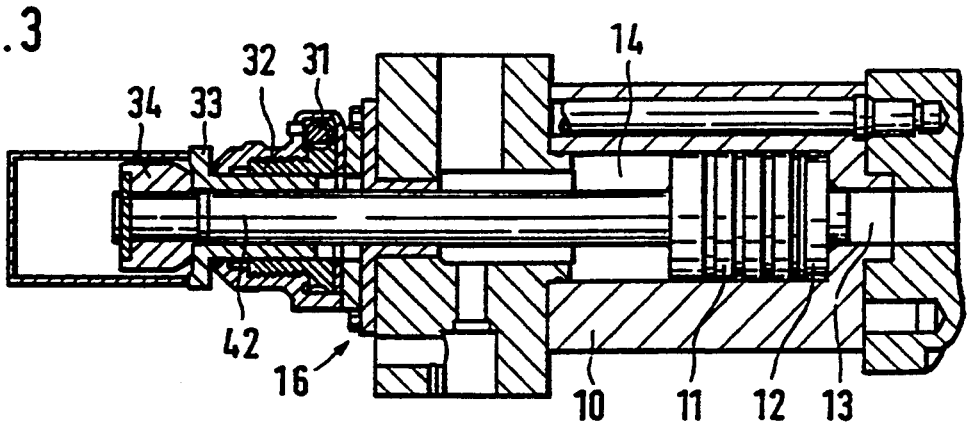
FIG. 3 is a sectional view that is enlarged in comparison to FIG. 1 of a control cylinder with an adjusting drive.

The stoppage times indicated in FIG. 2 by means of reference numbers 25, 26, 27 are controlled during the run-up of the pressure cheek 2 when the valve 17 is closed by the control cylinder 10, an adjusting drive 16 and a pressure source 15 comprising a pilot valve 18. A control piston 11 divides the pressure space of the control cylinder 10 into the first pressure space 12 and a second pressure space 14. The first pressure space 12 is in a constant flow connection with the pressure space 9 via a pressure line 13. The second pressure space 14 can be connected with the pressure source 15 via a pilot valve 18. As seen in FIG. 3, the piston rod 42 has a fixed stop 34 which, when pressure is admitted to the pressure space 14 by the pressure source 15, is moved against an adjustable stop on a threaded sleeve 33. The threaded sleeve 33 has an external thread which interacts with an internal thread of a worm gear 32 screwed onto the threaded sleeve 33 in the manner of a nut-spindle connection. The worm gear 32 can be rotatably driven by a motor driven worm 31. The motor, which is not shown, acts as the control device of the worm 31. The motor as well as the pilot valve 18, which as indicated in FIG. 1 by reference number 41, is connected with the press control 50. The position of the worm 31, the worm gear 32 or threaded sleeve 33 may be acquired by a coding device with signal return to the press control 50. The position of the piston 11 in the control cylinder 10, when the pressure space 14 is acted upon by pressure from the pressure source 15, is limited by the position of the stop 34 against the threaded sleeve 33.

Figure 4:
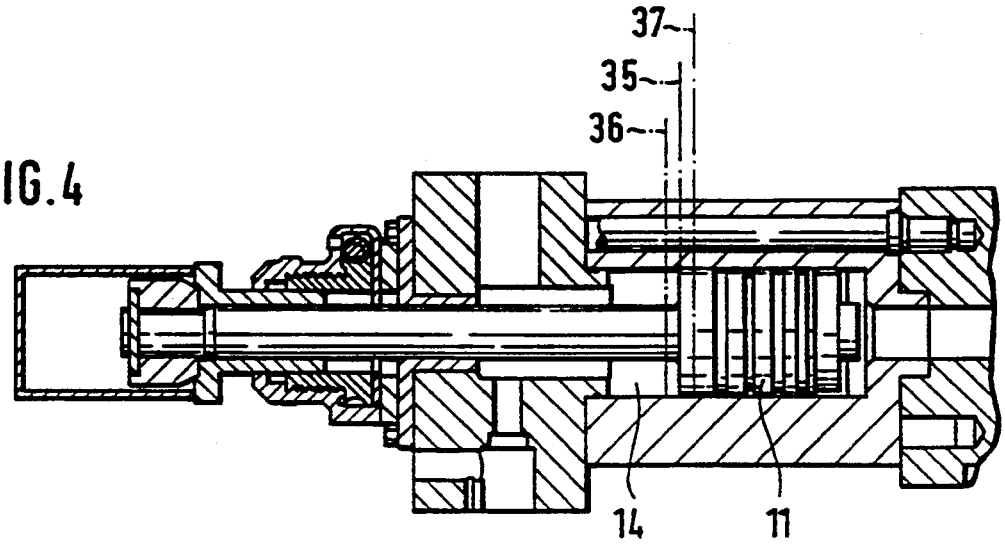
FIGS. 4 and 5 show a control cylinder in different stop positions.

The values determined during the first setting-up of a tool on the press are assigned to each tool and stored, and can be given via the press control 50, schematically shown. As examples of the present invention, the stoppage times 25 and 27 of FIG. 2 are examined in detail with respect to FIGS. 4 and 5. The stoppage time and the removal height 27 corresponding to FIG. 4 are reached by generating a second pressure space 14 which is large with respect to the volume when the stop 34 of the piston rod 42 is controlled correspondingly.

Figure 5:
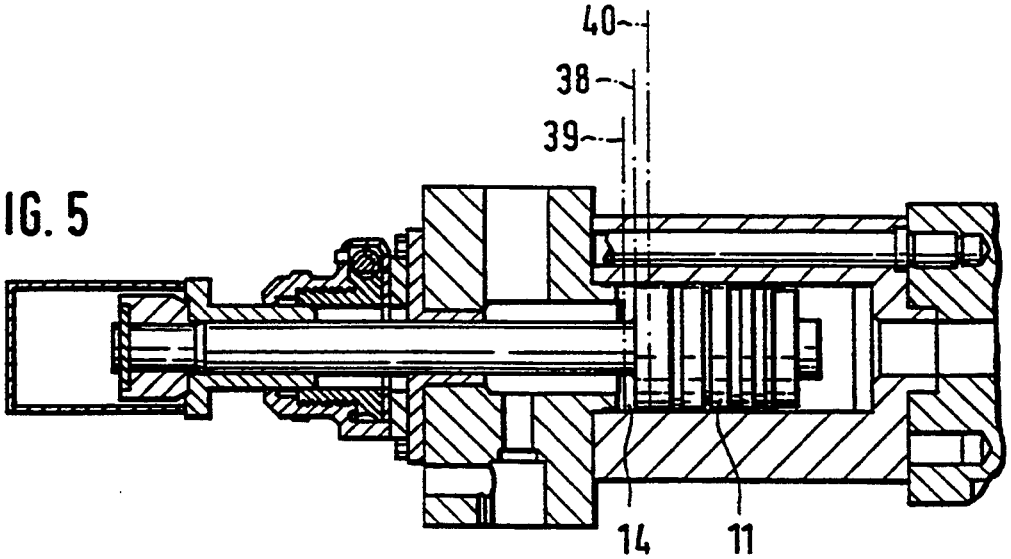

Accordingly, as illustrated in FIG. 5, a smaller second pressure space 14 must be provided for an initially smaller path of the drawing device 1 with the pressure cheek 2 until a workpiece is removed. This smaller second pressure space 14 can be adjusted via the stop control of the piston rod 42 by means of the train of gears 31 to 34.

In this case, the respective control piston position 35 for the first example (FIG. 4) and 38 for the second example (FIG. 5) with the corresponding stop setting and an open pilot valve 18 are achieved, and thus the admission of pressure to the second pressure space 14. For reaching the stoppage times 25, 26 or 27, the valve 17 must be controlled to be closed. Valve 18 must be switched such that the second pressure space 14 can be evacuated. The above representation indicates that, for example, in the case of a larger drawing depth by means of a corresponding tool, a larger piston path of the control piston 11 according to FIG. 4 must be provided in order to be able to remove the workpiece after the opening of the tool. In this case, the path is determined by the distance of the piston area 35 to the stop in the bottom of the control cylinder 10.

According to FIG. 5, a narrow distance of the piston area 38 to the stop in the bottom of the control cylinder 10 is given corresponding to the stoppage time 25 (removal height) which starts earlier with respect to time and path.

In addition, the control measures take into account different drawing pressures or blank-holding pressures. A higher drawing pressure causes a more extensive compressing of the fluid and a larger expansion of the system carrying the fluid and vice-versa.

For a longer path of the control piston 11 according to FIG. 4, while the drawing pressure is lower, in order to reach the stoppage time 27, the piston stop must take place in piston position 36. For a higher drawing pressure the piston stop takes place in stop position 37.

Correspondingly, for a shorter piston path according to FIG. 5, while the drawing pressure in the pressure spaces 6 of the drawing apparatus is higher, the piston 11 must be held in position 40; for a lower drawing pressure, the piston must be held in position 39 by means of the stop. It may be desirable to prevent the pressure cheek 2 from running up in the position which it takes up when passing through the lower dead center. The pressure cheek 2 will follow the slide run-up in a time-delayed manner. A volume adaptation in the sense of the examples of FIGS. 4 and 5 is also required for this stoppage time.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A run-up control for a pressure cheek in a drawing apparatus of a press, comprising:

a first piston rod with a pressure piston with an effective surface which can be acted upon in a drawing direction, the first piston rod being operatively connected with the pressure cheek, said pressure piston defining a main pressure space;

a press control;

a control cylinder having first and second pressure spaces and a second piston rod with a control piston that separates the first and second pressure spaces, the main pressure space being in a constant flow connection with the first pressure space, and the second piston rod extending out of the control cylinder;

a pressure generator;

a pilot valve controlled by the press control, the second pressure space being flow connected to the pressure generator via the pilot valve;

an actuating drive controlled by the press control;

an adjustable stop operatively connected to the actuating drive so as to be adjustable in a longitudinal dimension of the second piston rod;

a fixed stop coupled to the second piston rod, the fixed stop abutting against the adjustable stop when the second pressure space is pressurized via the pilot valve; and a controllable valve that controls fluid flow to and from the main pressure space and the first pressure space, wherein the controllable valve is controlled to a closed position during run-up of the pressure cheek such that the amount of fluid in the main pressure space and the first pressure space is constant during run-up of the pressure cheek.

2. A run-up control according to claim 1, wherein the actuating drive includes a worm gear and a worm, and wherein the adjustable stop is operatively connected with the worm gear in the manner of a nut-spindle drive for displacing the adjustable stop on the second piston rod.

* * * * *